US006537099B2

(12) United States Patent
Herlinger et al.

(10) Patent No.: US 6,537,099 B2
(45) Date of Patent: Mar. 25, 2003

(54) TAMPER PROOF ELECTRICAL CONNECTOR

(75) Inventors: George R. Herlinger, Niles, OH (US); Craig J. Coggins, Poland, OH (US); Courtney A. Mansky, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/935,075

(22) Filed: Aug. 22, 2001

(65) Prior Publication Data

US 2003/0040210 A1 Feb. 27, 2003

(51) Int. Cl.[7] ..... H01R 13/627
(52) U.S. Cl. ..... 439/352
(58) Field of Search ..... 439/352, 357–358, 439/372, 488–489, 464, 471

(56) References Cited

U.S. PATENT DOCUMENTS 4,674,814 A * 6/1987 Hoshino et al. ..... 439/582
4,746,306 A * 5/1988 Yurtin et al. ..... 439/352
4,941,839 A * 7/1990 Nagasaka et al. ..... 439/352
5,320,556 A * 6/1994 Otaka et al. ..... 439/372
5,338,211 A * 8/1994 Kodama et al. ..... 439/489
5,437,559 A * 8/1995 Okumura et al. ..... 439/352
5,628,648 A * 5/1997 Higgins, Jr. et al. ..... 439/489
5,655,928 A * 8/1997 Akeda ..... 439/489
5,722,849 A * 3/1998 Alwine ..... 439/352
5,820,398 A * 10/1998 Stabroth et al. ..... 439/352
5,830,000 A * 11/1998 Shifflett et al. ..... 439/352
6,012,946 A * 1/2000 Fukase ..... 439/352
6,224,414 B1 * 5/2001 Fukuda ..... 439/352

* cited by examiner

*Primary Examiner*—P. Austin Bradley
*Assistant Examiner*—Felix D. Figueroa
(74) *Attorney, Agent, or Firm*—Thomas N. Twomey

(57) ABSTRACT

A tamper proof electrical connector has a plug which inserts into a receptacle housing. A leading portion of the plug resides within the receptacle housing and a unitary trailing portion of the plug projects outward from the housing. A tab projects laterally outward from the receptacle housing and snap locks to a cantilevered member engaged unitarily to the trailing portion of the plug. A barrier wall projects laterally outward from the receptacle housing and substantially surrounds the cantilevered member and tab. A hood has a perimeter wall and a resilient hinge engaged to a base of the cantilevered member. When assembled, the perimeter wall of the hood surrounds the barrier wall of the receptacle housing. Two prongs project downward from a top portion of the hood snap locking to opposing first and second walls of the barrier wall disposed on either side of the tab. The first and second walls are disposed between the perimeter wall and the respective first and second prongs of the hood.

12 Claims, 4 Drawing Sheets

TAMPER PROOF ELECTRICAL CONNECTOR

TECHNICAL FIELD

The present invention relates to a tamper proof electrical connector and more particularly to an electrical connector having a mating connector body that is locked together by a flexible latch arm.

BACKGROUND OF THE INVENTION

Electrical connectors simplify the manufacturing wiring process when combining multiple electrical components to form a working system. A connector, once mated can be locked together similar to that shown in Yurtin et al, U.S. Pat. No. 4,746,306, incorporated herein by reference. The connector must be unlocked prior to un-mating of the connector.

Repair or maintenance of any one component within the assembled system may require removal of the component and un-mating of the connectors. For a component to operate reliably, it may require calibration. Likewise, for the system to operate reliably, the system as a whole must be calibrated. When re-inserting a repaired component, the initial calibration of the system may subsequently change without operator knowledge. Therefore, the ability to disconnect and re-connect an electrical connector may unwantedly assist in the ability to alter or degrade calibration of a system.

SUMMARY OF THE INVENTION

A tamper proof electrical connector has a plug which inserts through a hole defined by a leading surface of a receptacle housing. A leading portion of the plug resides within the receptacle housing and a trailing portion of the plug projects outward through the hole. A tab projects laterally outward from the receptacle housing snap locking to a cantilevered member engaged unitarily to the trailing portion of the plug. A barrier wall projects laterally outward from the receptacle housing and substantially surrounds the cantilevered member. Preferably, a hood has a perimeter wall and a resilient hinge engaged to a base of the cantilevered member. When assembled, the perimeter wall of the hood surrounds the barrier wall of the receptacle housing. Two prongs project downward from a top portion of the hood snap locking to opposing first and second walls of the barrier wall disposed on either side of the tab. The first and second wall are disposed between the perimeter wall and the respective first and second prongs of the hood.

A feature of the present invention is the inability to unplug the electrical connector without visually and physically destroying the locking aspect features of the connector.

DESCRIPTION OF THE DRAWINGS

The presently preferred embodiments of the invention are disclosed in the following description and accompanying drawings wherein.

DETAILED DESCRIPTION OF THE PREFERRED EMBODIMENTS

Figure 1:
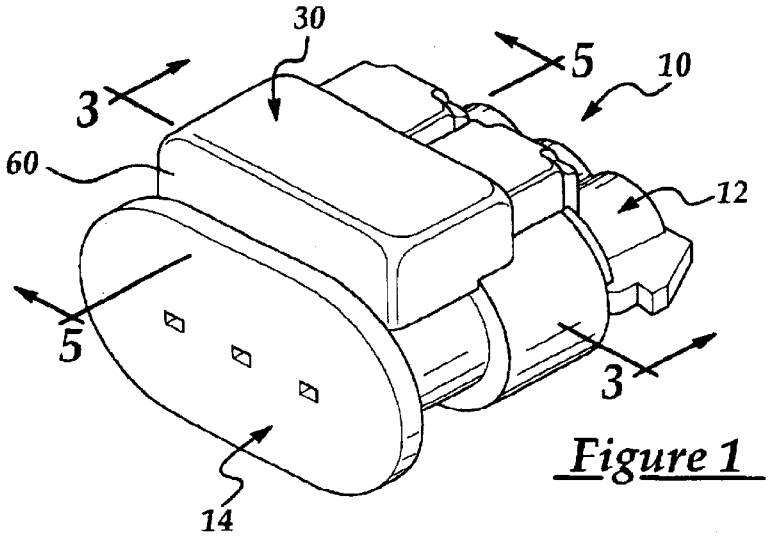
FIG. 1 is a perspective view of a tamper proof electrical connector of the present invention.
Figure 2:
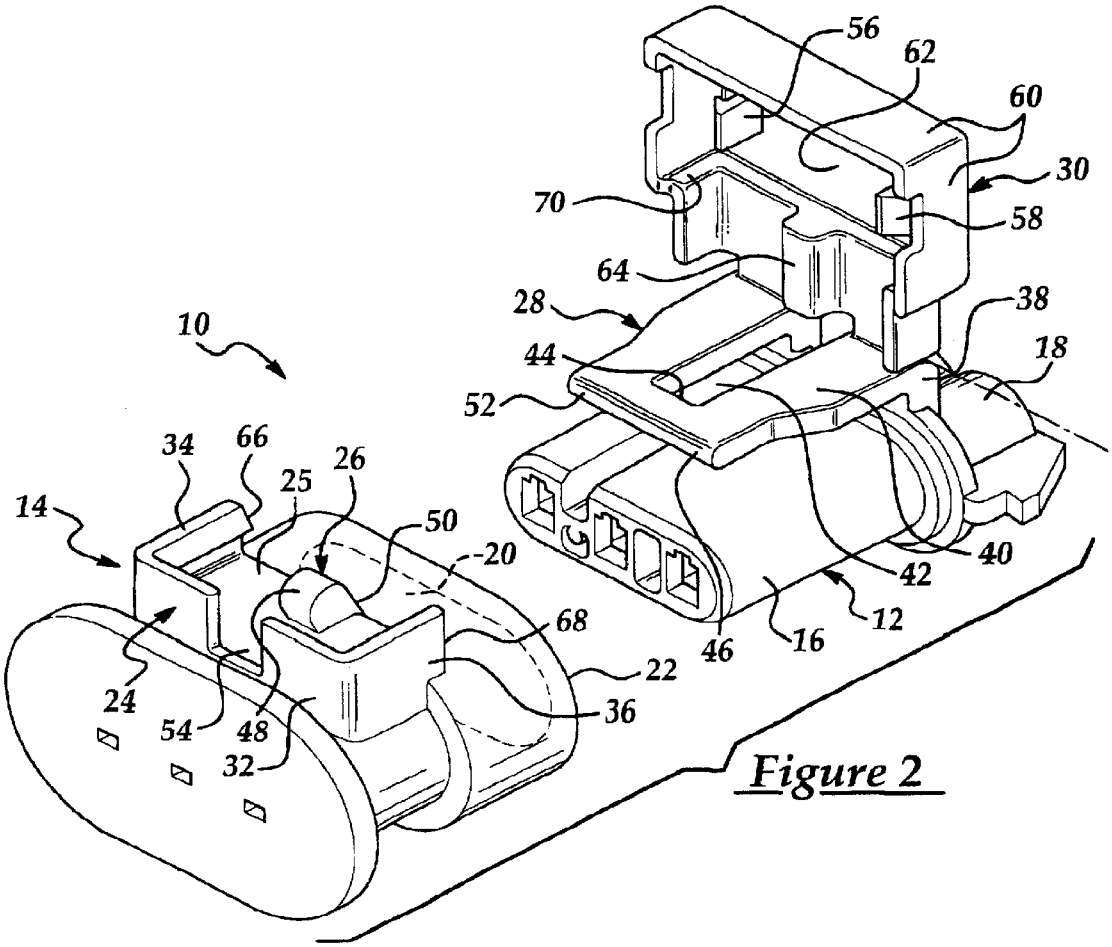
FIG. 2 is an exploded perspective view of the electrical connector.

Referring to FIGS. 1–2, a tamper proof electrical connector 10 is shown having a plug 12 which mates into a receptacle housing 14. A leading portion 16 of the plug 12 resides within the housing 14 and a trailing portion 18 of the plug projects outward from the receptacle housing 14 through a hole 20 defined by a leading face 22 of the housing.

Projecting laterally outward from the receptacle housing 14 is a U-shaped barrier wall 24 which defines an alcove 25. A tab 26 disposed within the alcove 25 also projects laterally outward from the receptacle housing 14. The barrier wall 24 includes an intermediate wall 32 extending between trailing ends of first and second side walls 34, 36. Tab 26 of the receptacle housing 14 is orientated longitudinally and located between the leading face 22 of the housing 14 and the intermediate wall 32 of the barrier wall 24. Tab 26 is spaced laterally between the first side wall 34 and the second side wall 36 of the barrier wall 24.

A cantilevered member 28 engaged unitarily to the trailing portion 18 of the plug 12 extends longitudinally forward and over the leading portion 16. During mating, cantilever member 28 snap-locks about the tab 26 of the receptacle housing 14 of the electrical connector 10. A hood 30 is provided to prevent connector tampering, that is, prying the cantilevered member 28 off of the tab 26 and unplugging the electrical plug 12. Hood 30 is preferably hinged to the trailing portion 18 of the plug 12 by a flexible unitary member 31 enabling the hood 30 to close, that is, pivot over and snap-lock about the barrier wall 24, and an arm 40 of the cantilevered member 28 as best shown in FIGS. 3 and 4.

Figure 3:
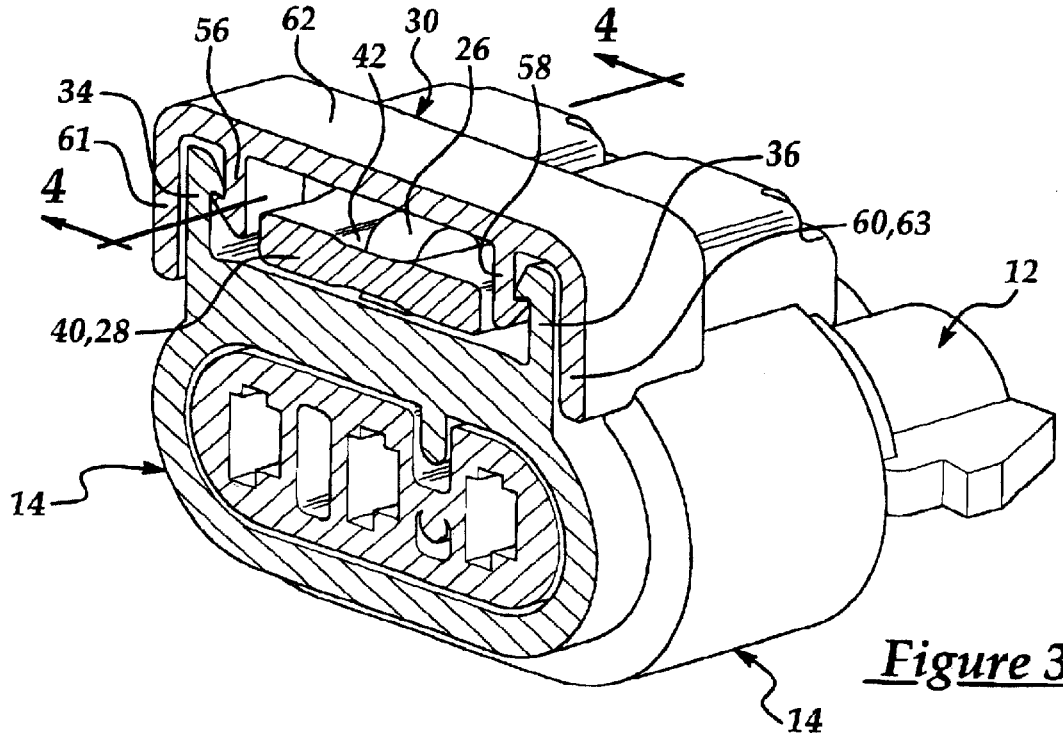
FIG. 3 is a cross-section view of the electrical connector taken along line 3—3 viewing in the direction of the arrows of FIG. 1.
Figure 4:
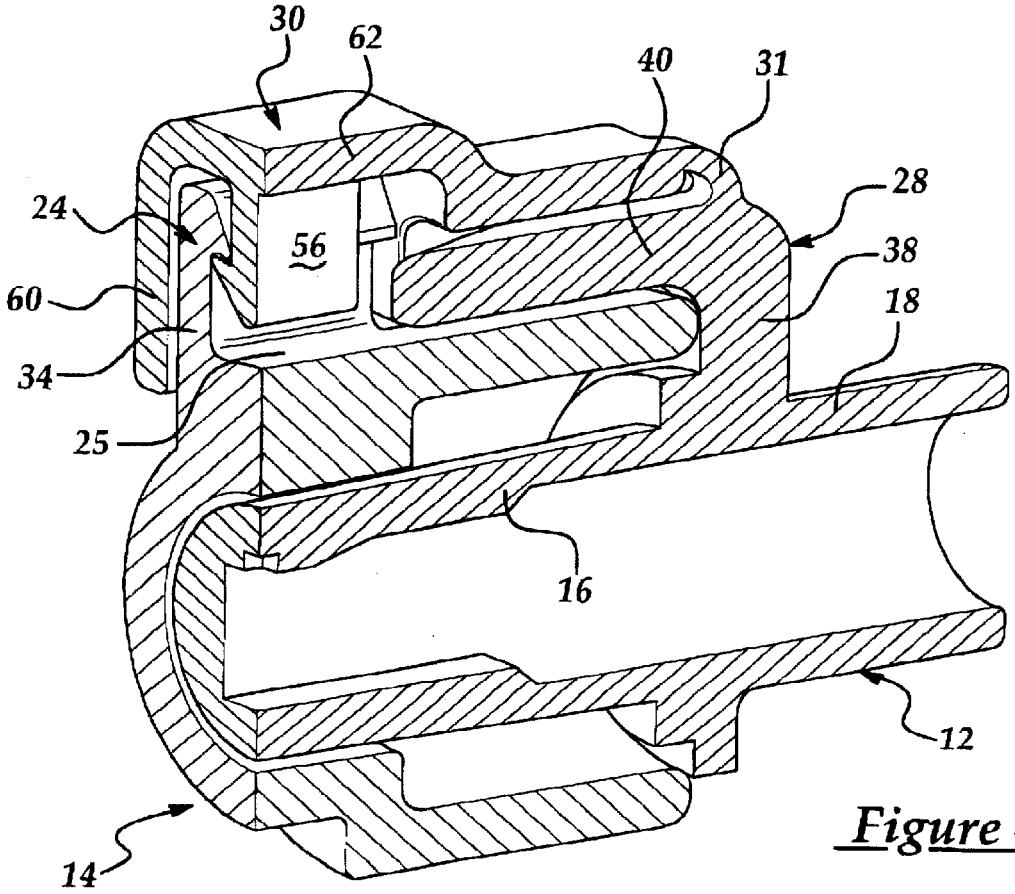
FIG. 4 is a cross-section view of the electrical connector taken along line 4—4 viewing in the direction of the arrows of FIG. 3.

Referring to FIGS. 2–4, the cantilevered member 28 has a base 38 which projects laterally outward from the trailing portion 18 of the plug 12. The arm 40 is engaged unitarily to the distal end of the base 38 and projects longitudinally over the leading portion 16 of the plug 12 beneath the hood 30 when closed. The arm 40 is separated laterally from the leading portion 16 so that during mating a wall of the receptacle housing 14 slides into the space between the leading portion 16 of the plug 12 and the arm 40 of the cantilevered member 28. When mated, tab 26 projects laterally outward through a slot 42 which projects longitudinally along the arm 40. Defining the leading end of slot 42 is a trailing contact edge 44 at a distal end 46 of the arm 40 which is also disposed beneath the closed hood 30.

When mated, a trailing contact surface 48 of the tab 26 engages the trailing contact edge 44 of the cantilevered member 28 along an imaginary plane which traverses the electrical connector 10. During mating, an opposite leading ramped surface 50 of the tab 26 contacts a rounded leading edge 52 of the distal end portion 46 causing the cantilevered member 28 to flex upward or laterally outward until the tab 26 passes the distal end portion 46 and snaps into the slot 42. With tab 26 disposed in slot 42, the first and second walls 34, 36 of barrier wall 24 are positioned to prevent tampering or lifting of arm 40 from either side, thereby preventing unlocking of the electrical connector 10 either-side.

Preferably, the barrier wall 24 has a divot 54 centered along the intermediate wall 32 and defined by the laterally outward edge. When hood 30 is open as shown in FIG. 2, the divot 54 permits insertion of a tool, such as a screwdriver, into the alcove 25 to engage the underside of the distal end portion 46 of the cantilevered member 28 and pry the cantilever member 28 laterally outward releasing it from the tab 26 and unlocking the electrical connector 10. This capability, however, is eliminated when the hood 30 is pivoted over and snap-locked onto the receptacle housing 14 thereby surrounding the exterior sides of barrier wall 24.

Referring to FIGS. 3 and 4, a trailing end or side of the hood 30 is engaged unitarily to the integral resilient hinge or member 31 which is engaged unitarily to the distal end of the base 38 of the cantilevered member 28. When plug 12 and housing 14 are plugged together and locked, and hood 30 is closed, first and second prongs 56, 58 project downward or laterally inward from an inner surface of a top portion 62 of the hood 30 to snap-lock onto the respective first and second side walls 34, 36 of the barrier wall 24. The first and second prongs 56, 58 are substantially planar and longitudinally aligned to the connector 10. Preferably, the first and second prongs 56, 58 and the first and second walls 34, 36 each have ramped surfaces extending longitudinally along their distal edges effectively forming an enlarged distal head with inward facing shelves. When hood 30 is closed the respective ramped surfaces engage, flexing the respective wall and prong until the surfaces pass one-another causing the inward shelves to make contact with one-another.

Engaged along the perimeter of the top portion 62 of hood 30 and disposed perpendicular thereto is a perimeter wall 60. The top portion 62 is disposed laterally above the barrier wall 24. The perimeter wall 60 encompasses the barrier wall 24 wherein the first side wall 34 is disposed between a side portion or wall 61 of the perimeter wall 60 and the first prong 56. Likewise, the second side wall 36 is disposed between the second prong 58 and the opposite side wall 63 of the perimeter wall 60. The first prong 56 snap-locks to the first side wall 34 and the second prong 58 snap-locks to the second side wall 36. The location of the side walls 34, 36 between the perimeter wall 60 and the prongs 56, 58 when hood 30 is closed, eliminates any possibility of flexing side walls 34, 36 or prongs 56, 58 to unlock the hood 30 from the barrier wall 24. This assures that access to the cantilevered member 28 which is locked to the tab 26 cannot be achieved without excessive tampering and visual damage to the electrical connector 10 in general and to the hood 30 in particular.

Figure 5:
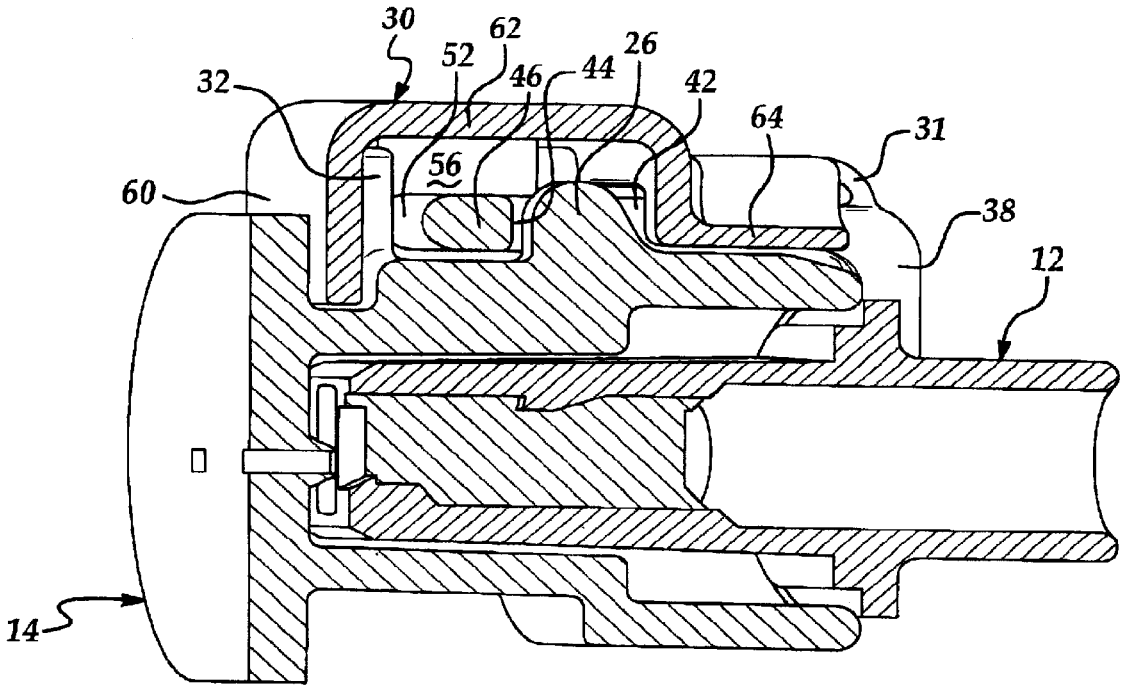
FIG. 5 is a cross-section view of the electrical connector taken along line 5—5 viewing in the direction of the arrows of FIG. 1.

Referring to FIGS. 2 and 5, projecting downward or laterally inward from the inner surface of the top portion 62 is a filler member 64. In assembly, the filler member 64 projects through the slot 42 of the cantilevered member 28 from above so that the member 64 is orientated rearward or behind the tab 26. This enhances rigidity of the electrical connector 10 and the locking connection of the hood 30 to the cantilevered member 28, and prevents disengagement or tampering of the cantilevered member 28 from the rear, between the arms 40 of the member 28.

To enhance the longitudinal rigidity of the electrical connector 10, the first and second side walls 34, 36 have respective leading end surfaces 66, 68 which engage a leading shelf 70 defined by the inner surface of the hood 30. The shelf 70 is substantially planar to, or flush with, the leading end surface of the filler member 64. Similarly, the leading end surfaces 66, 68 of the first and second side walls 34, 36 lie substantially along the same imaginary plane as the leading shelf 70 wherein the plane traverses the electrical connector 10.

Figure 6:
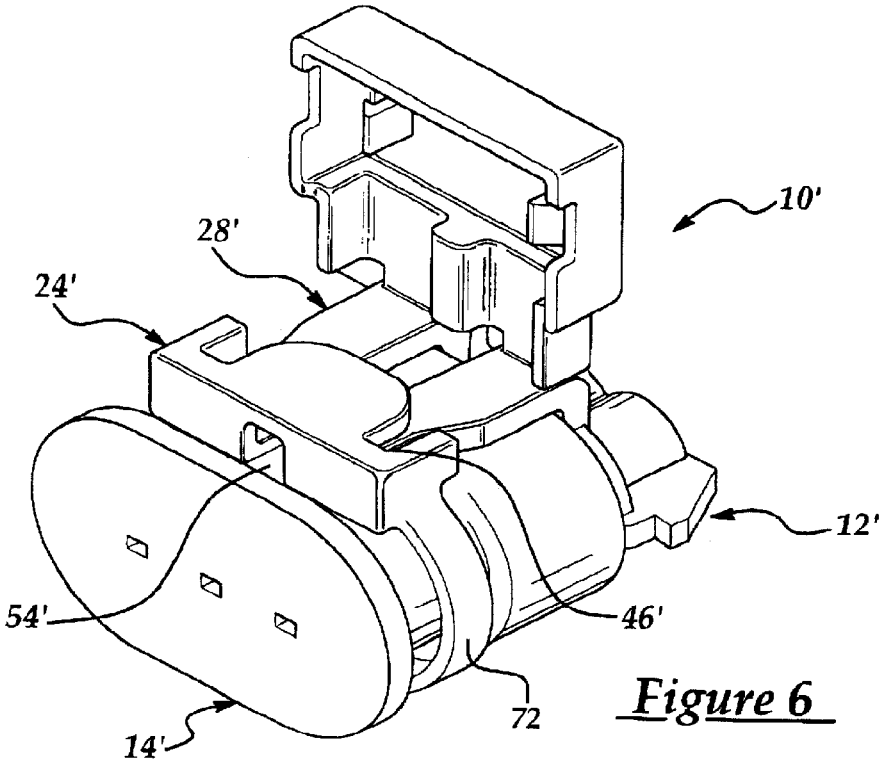
FIG. 6 is a perspective view of a second embodiment of an electrical connector of the present invention.
Figure 7:
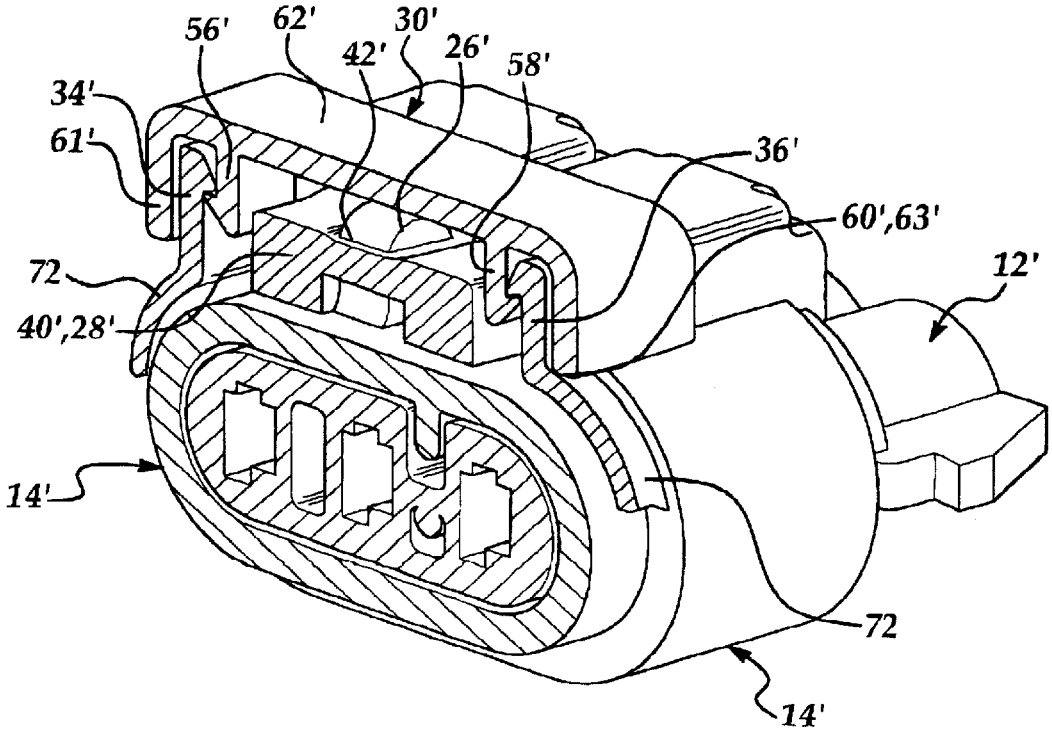
FIG. 7 is a perspective lateral cross section view of the second embodiment of the electrical connector.

Referring to FIGS. 6 and 7, a second embodiment of the electrical connector 10' is shown. Unlike the first embodiment, the housing 14' does not have a barrier wall engaged directly and unitarily. Instead, a barrier wall 24' is directly engaged to a strap 72 which circumferentially surrounds the receptacle housing 14'. The divot 54' of the barrier wall 24' extends downward or communicates inwardly toward the receptacle housing 14' so that the tab 26', not shown, can move therethrough during assembly. The barrier wall and strap of the connector 10' are useful when design modifications to pre-existing connector houses are not an option.

Although the preferred embodiments of the present invention are disclosed various changes and modifications may be made thereto by one skilled in the art without departing from the scope and spirit of the invention as set forth in the appended claims. Furthermore it is understood that the terms used herein are merely descriptive rather than limiting and various changes may be made without departing from the scope and spirit of the invention.

What is claimed is:

1. An electrical connector comprising:

a receptacle housing having a leading face defining a hole;

a plug having a leading portion and a trailing portion, the leading portion disposed within the receptacle housing, the trailing portion being engaged to the leading portion and projecting longitudinally outward from the hole of the receptacle housing;

a tab projecting laterally outward directly from the receptacle housing;

a barrier wall projecting laterally outward from the receptacle housing and defining an alcove opened rearward, the tab being disposed within the alcove;

a cantilevered member engaged to the trailing portion and extended longitudinally over the leading portion, the cantilevered member disposed within the alcove of the barrier wall and snap locked to the tab of the receptacle housing; and a hold disposed over the tab and the cantilever member and engage operatively to the barrier wall in a closed position, wherein the hood is engage unitarily to the plug via a resilient hinge.

2. The electrical connector set forth in claim 1 wherein the barrier wall has a first side wall projecting upward from the receptacle housing, a second side wall projecting upward from the receptacle housing, and an intermediate wall projecting upward from the receptacle housing and engaged between the first and second side walls.

3. The electrical connector set forth in claim 2 wherein the hood has a top portion and a perimeter wall projecting from the top portion toward the receptacle housing, the barrier wall disposed inward from the perimeter wall.

4. The electrical connector set forth in claim 3 wherein the hood has a prong engaged to the top portion and projected into the alcove, the prong snap locked to the barrier wall.

5. The electrical connector set forth in claim 4 wherein the cantilevered member has a base, an arm, a distal end portion, and a slot, the base engaged to and extended laterally outward from the trailing portion of the plug, the arm extended between the base and the distal end portion, the slot extended longitudinally along the arm, the arm being spaced from and extended over the leading portion of the plug, the tab projecting into the slot, and the distal end portion disposed longitudinally between the intermediate wall of the barrier wall and the tab within the alcove.

6. The electrical connector set forth in claim 5 wherein the resilient hinge is engaged to the base.

7. The electrical connector set forth in claim 6 wherein the hinge has a hinge axis extended laterally to the plug, the hinge axis being perpendicular to the slot of the cantilevered member, and wherein the first and second side walls of the barrier wall extend longitudinally to the receptacle housing.

8. The electrical connector set forth in claim 7 wherein the hinge is unitary to the hood and the plug.

9. The electrical connector set forth in claim 8 further comprising:

the tab having a trailing contact surface and an opposite leading ramped surface; and the distal end portion of the cantilevered member having a leading edge and an opposite trailing contact edge engaged to the contact surface of the tab, the leading ramped surface being formed to slideably engage the leading edge of the distal end portion for flexing the cantilevered member outward when mating the receptacle housing to the plug.

10. An electrical connector comprising:

a receptacle housing having a leading face defining a hole;

a plug having a leading portion and a trailing portion, the leading portion disposed within the receptacle housing, the trailing portion being engaged to the leading portion and projecting longitudinally outward from the hole of the receptacle housing;

a tab projecting laterally outward from the receptacle housing;

a barrier wall projecting laterally outward from the receptacle housing, the barrier wall having a first side wall, a second side wall and an intermediate wall engaged between the first and second side walls, the first and second wall extended longitudinally with respect to the receptacle housing, wherein the barrier wall defines an alcove opened rearward and the tab is disposed within the alcove;

a cantilevered member having a base, a distal end portion, an arm and a slot, the base engaged to and extended laterally outward from the trailing portion of the plug, the arm extended between the base and the distal end portion and longitudinally over the leading portion of the plug, and the slot extended longitudinally along the arm, wherein the distal end portion and the arm are disposed within the alcove of the barrier wall, the distal end portion is disposed longitudinally forward of the tab and the tab is snap locked into the slot when the electrical connector is mated;

a hood having a resilient hinge, a prong, a top portion and a perimeter wall, the resilient hinge being unitary to the hood and the plug and engaged operatively to the base of the cantilevered member, the top portion disposed over the tab and the cantilevered member, the prong projecting downward from the top portion and into the alcove of the barrier wall, the perimeter wall projecting from the top portion toward the receptacle housing, wherein the barrier wall is disposed inward from the perimeter wall and the prong is snap locked to the barrier wall;

the resilient hinge having a hinge axis extended laterally to the plug, the hinge axis being perpendicular to the longitude of the slot of the cantilevered member;

the tab having a trailing contact surface and an opposite leading ramped surface;

the distal end portion of the cantilevered member having a leading edge and an opposite trailing contact edge engaged to the contact surface of the tab, the leading ramped surface being formed to slideably engage the leading edge of the distal end portion for flexing the cantilevered member outward when mating the receptacle housing to the plug; and wherein the prong is a first prong engaged to the first side wall and wherein the hood has a second prong engaged to the second sidewall, the second side wall being disposed between the second prong and the perimeter wall of the hood.

11. The electrical connector set forth in claim 10 wherein the hood has a filler member projecting from the top portion of the hood and into the slot longitudinally between the base of the cantilevered member of the plug and the tab of the receptacle housing.

12. An electrical connector comprising:

a receptacle housing;

a plug having a leading portion and a trailing portion, the leading portion disposed within the receptacle housing, the trailing portion being engaged to the leading portion and projecting longitudinally outward from the receptacle housing;

a tab engaged unitarily to and projecting laterally outward from the receptacle housing, the tab having a contact surface;

a barrier wall disposed laterally outward from the receptacle housing, the barrier wall having a first wall and a second wall extending longitudinally with respect to the plug, and wherein the tab is spaced between the first and second walls;

a cantilevered member engaged to the trailing portion and extended longitudinally over the leading portion, the member snap locked over the tab of the receptacle housing; and a hood having a top portion and a perimeter wall, the perimeter wall projecting toward the leading portion of the plug from the top portion, the perimeter wall surrounding the barrier wall, wherein the barrier wall is unitarily engaged to a strap disposed circumferentially about the receptacle housing.

* * * * *